US011136101B2

(12) United States Patent
Mizutani

(10) Patent No.: US 11,136,101 B2
(45) Date of Patent: Oct. 5, 2021

(54) BOAT SPEED CONTROL DEVICE AND BOAT MANEUVERING SYSTEM

(71) Applicant: YAMAHA HATSUDOKI KABUSHIKI KAISHA, Iwata (JP)

(72) Inventor: Makoto Mizutani, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 27 days.

(21) Appl. No.: 16/609,503

(22) PCT Filed: Sep. 4, 2017

(86) PCT No.: PCT/JP2017/031797
§ 371 (c)(1),
(2) Date: Oct. 30, 2019

(87) PCT Pub. No.: WO2018/211719
PCT Pub. Date: Nov. 22, 2018

(65) Prior Publication Data

US 2020/0140050 A1 May 7, 2020

(30) Foreign Application Priority Data

May 18, 2017 (JP) ..... JP2017-098731

(51) Int. Cl.
*B63H 20/16* (2006.01)

(52) U.S. Cl.
CPC ..... *B63H 20/16* (2013.01)

(58) Field of Classification Search
CPC ..... B63H 20/16
See application file for complete search history.

(56) References Cited

U.S. PATENT DOCUMENTS 2,070,406 A * 2/1937 Irgens ..... F02D 27/00 440/63
5,408,230 A * 4/1995 Okita ..... B63H 20/14 340/12.22
7,354,325 B2 * 4/2008 Mizuguchi ..... B63H 20/20 440/61 S
7,805,225 B2 * 9/2010 Okuyama ..... B63H 21/213 701/2

(Continued)

FOREIGN PATENT DOCUMENTS

JP 06-80098 A 3/1994
JP 08-2489 A 1/1996

(Continued)

OTHER PUBLICATIONS

Official Communication issued in International Patent Application No. PCT/JP2017/031797, dated Oct. 31, 2017.

*Primary Examiner* — S. Joseph Morano
*Assistant Examiner* — Jovon E Hayes
(74) *Attorney, Agent, or Firm* — Keating & Bennett, LLP

(57) ABSTRACT

A boat speed control device for a boat including a manual shifter and an outboard motor, includes an actuator and a controller. The outboard motor is operably connected to the manual shifter. The manual shifter includes a shift lever shiftable between a sailing position and a neutral position. The actuator is connected to the shift lever. The controller is configured or programmed to control the actuator to shift the shift lever to the sailing position and the neutral position.

24 Claims, 10 Drawing Sheets

(56) References Cited

U.S. PATENT DOCUMENTS

| | | | | |
|---|---|---|---|---|
| 2004/0082235 | A1* | 4/2004 | Ochiai | B63H 21/21 440/84 |
| 2006/0009096 | A1* | 1/2006 | Takada | B63H 21/213 440/84 |
| 2006/0213301 | A1* | 9/2006 | Mizuguchi | F16H 61/32 74/335 |
| 2007/0270054 | A1* | 11/2007 | Ito | F02D 29/02 440/75 |
| 2008/0015747 | A1* | 1/2008 | Hiroshima | F02D 11/105 701/21 |
| 2016/0349767 | A1* | 12/2016 | Ito | B63H 20/20 |

FOREIGN PATENT DOCUMENTS

| | | | | |
|---|---|---|---|---|
| JP | 2009-208606 | A | 9/2009 | |
| JP | 2016-216018 | A | 12/2016 | |
| JP | 2009-208606 | * | 9/2017 | B63H 20/16 |

* cited by examiner

BOAT SPEED CONTROL DEVICE AND BOAT MANEUVERING SYSTEM

BACKGROUND OF THE INVENTION

1. Field of the Invention

The present invention relates to a boat speed control device and a boat maneuvering system.

2. Description of the Related Art

Conventionally, a boat speed control device for automatically adjusting the navigation speed of a boat has been proposed. For example, JP-A-6-80098 discloses a trolling device for navigating a boat at ultra-low speed. In this trolling device, the amount of lubricating oil applied to the friction plates of the forward clutch and the reverse clutch is adjusted by a proportional solenoid valve so that the boat travels at ultra-low speed.

The conventional boat speed control device described above is difficult to apply to a boat provided with a shift mechanism that is not hydraulic. Further, even for a boat equipped with a hydraulic shift mechanism, it is not easy to retrofit the boat speed control device because the hydraulic circuit needs to be changed. In particular, since a large space is required for mounting the boat speed control device, it is not easy to mount the boat speed control device on a small boat.

SUMMARY OF THE INVENTION

Preferred embodiments of the present invention provide boat speed control devices that are each easily mounted on a small boat.

According to a preferred embodiment of the present invention, a boat speed control device for a boat including a manual shifter and an outboard motor operably connected to the manual shifter includes an actuator and a controller. The manual shifter includes a shift lever shiftable between a sailing position and a neutral position. The actuator is connected to the shift lever. The controller is configured or programmed to control the actuator to shift the shift lever to the sailing position and the neutral position.

According to a preferred embodiment of the present invention, a boat maneuvering system includes a manual shifter, an outboard motor, and a boat speed control device. The manual shifter includes a shift lever shiftable between a sailing position and a neutral position. The outboard motor is operably connected to the manual shifter. The boat speed control device includes an actuator and a controller. The actuator is connected to the shift lever. The controller is configured or programmed to control the actuator to shift the shift lever to the sailing position and the neutral position.

According to a preferred embodiment of the present invention, the controller controls the actuator to shift the shift lever to the neutral position and the sailing position. Therefore, the boat speed control device is able to be small and operate the shift lever. Therefore, the boat speed control device is easily mounted on a small boat.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
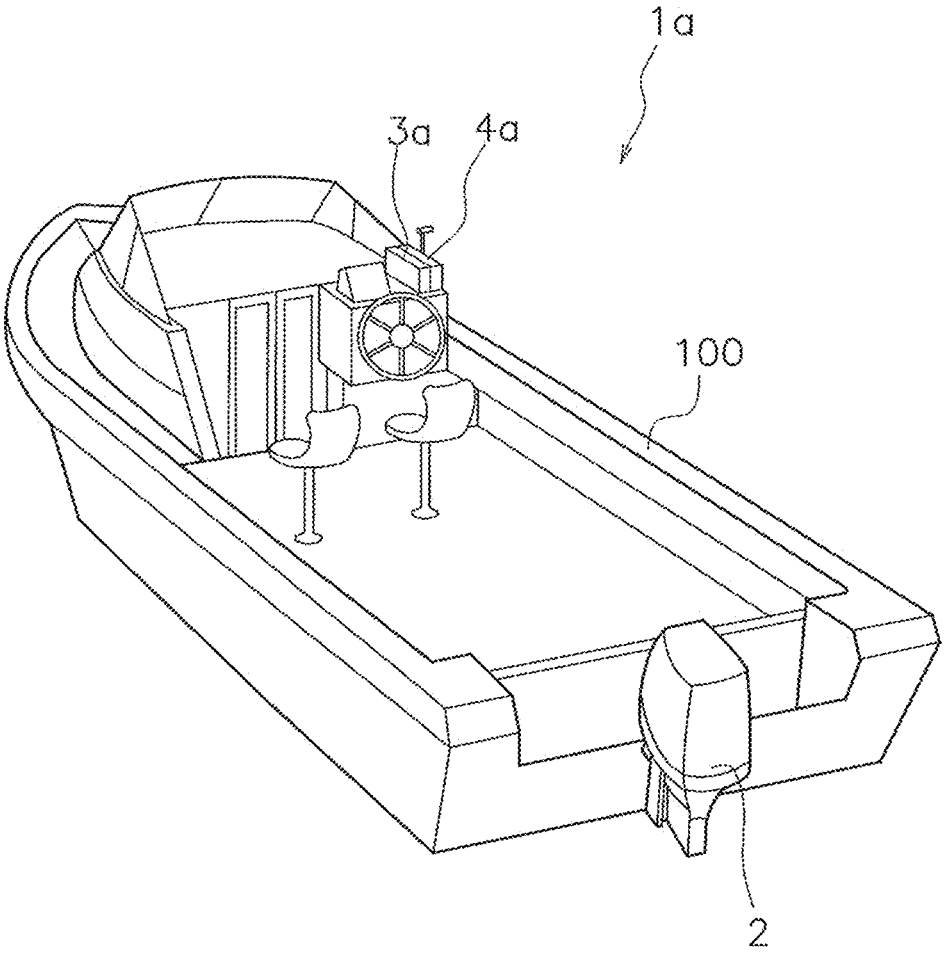
FIG. 1 is a perspective view showing a boat including a boat maneuvering system according to a first preferred embodiment of the present invention.

Hereinafter, preferred embodiments will be described with reference to the drawings. FIG. 1 is a perspective view showing a boat 100 including a boat maneuvering system 1*a* according to the first preferred embodiment of the present invention. The boat maneuvering system 1*a* includes an outboard motor 2, a manual shifter 3*a*, and a boat speed control device 4*a*.

The outboard motor 2 is attached to the stern of the boat 100. The outboard motor 2 generates a propulsive force that propels the boat 100. In the present preferred embodiment, the number of outboard motors 2 is one, for example, but two or more outboard motors 2 may be mounted on the boat 100.

The manual shifter 3*a* is disposed at the operator seat of the boat 100. The manual shifter 3*a* allows an operator to adjust the boat speed. The manual shifter 3*a* also allows the operator to switch between forward and reverse travel of the boat 100.

Figure 2:
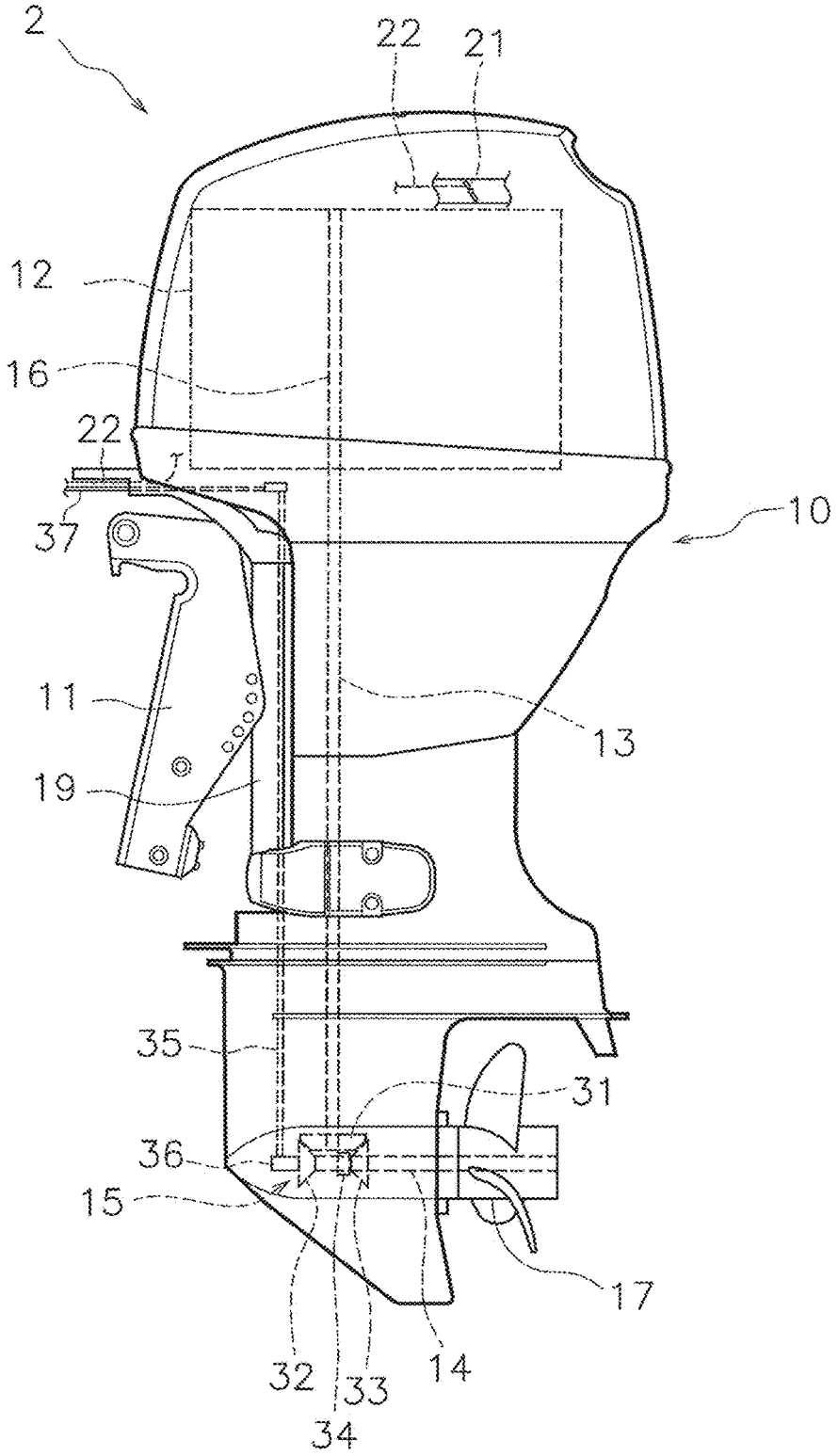
FIG. 2 is a side view of the outboard motor.

FIG. 2 is a side view of the outboard motor 2. The outboard motor 2 is attached to the boat 100 via the bracket 11. The outboard motor 2 includes an engine 12, a drive shaft 13, a propeller shaft 14, and a shift mechanism 15.

The engine 12 generates a propulsive force that propels the boat 100. The engine 12 includes a throttle valve 21. The throttle valve 21 adjusts an amount of the intake air to the engine 12. The throttle valve 21 is connected to a throttle cable 22. The opening degree of the throttle valve 21 is changed by the push-pull operation of the throttle cable 22. Thus, engine speed is controlled.

The engine 12 includes a crankshaft 16. The crankshaft 16 extends in the vertical direction. The drive shaft 13 is connected to the crankshaft 16. The drive shaft 13 extends in the vertical direction. The propeller shaft 14 extends in the front-rear direction. The propeller shaft 14 is connected to the drive shaft 13 via the shift mechanism 15. A propeller 17 is connected to the propeller shaft 14.

The shift mechanism 15 switches the rotation direction of the power transmitted from the drive shaft 13 to the propeller shaft 14. The shift mechanism 15 includes a bevel gear 31, a forward gear 32, a reverse gear 33, and a dog clutch 34. The bevel gear 31 is connected to the drive shaft 13. The forward gear 32 and the reverse gear 33 are engaged with the bevel gear 31.

The dog clutch 34 switches between connection and release of the forward gear 32 and the propeller shaft 14 and connection and release of the reverse gear 33 and the propeller shaft 14 by moving in the axial direction of the propeller shaft 14. That is, the shift mechanism 15 is switched between the forward movement state and the reverse movement state.

When the shift mechanism 15 is in the forward movement state, the forward gear 32 and the propeller shaft 14 are connected such that the rotation of the drive shaft 13 is transmitted to the propeller shaft 14 via the bevel gear 31 and the forward gear 32. Thus, the propeller shaft 14 rotates in the direction in which the boat 100 moves forward. When the shift mechanism 15 is in the reverse movement state, the reverse gear 33 and the propeller shaft 14 are connected to transmit the rotation of the drive shaft 13 to the propeller shaft 14 via the bevel gear 31 and the reverse gear 33. Thus, the propeller shaft 14 rotates in the direction in which the boat 100 moves backward. When both the forward gear 32 and the reverse gear 33 are released from the propeller shaft 14, the shift mechanism 15 is in a neutral state in which the rotation of the drive shaft 13 is not transmitted to the propeller shaft 14.

The shift mechanism 15 includes a shift rod 35 and a shift cam 36. The shift rod 35 is connected to the shift cable 37. The shift rod 35 rotates by a push-pull operation of the shift cable 37. The shift cam 36 is connected to the shift rod 35 and moves in the axial direction of the propeller shaft 14 due to the rotation of the shift rod 35. The shift cam 36 is connected to the dog clutch 34, and the dog clutch 34 moves in the axial direction of the propeller shaft 14 by the movement of the shift cam 36.

Figure 3:
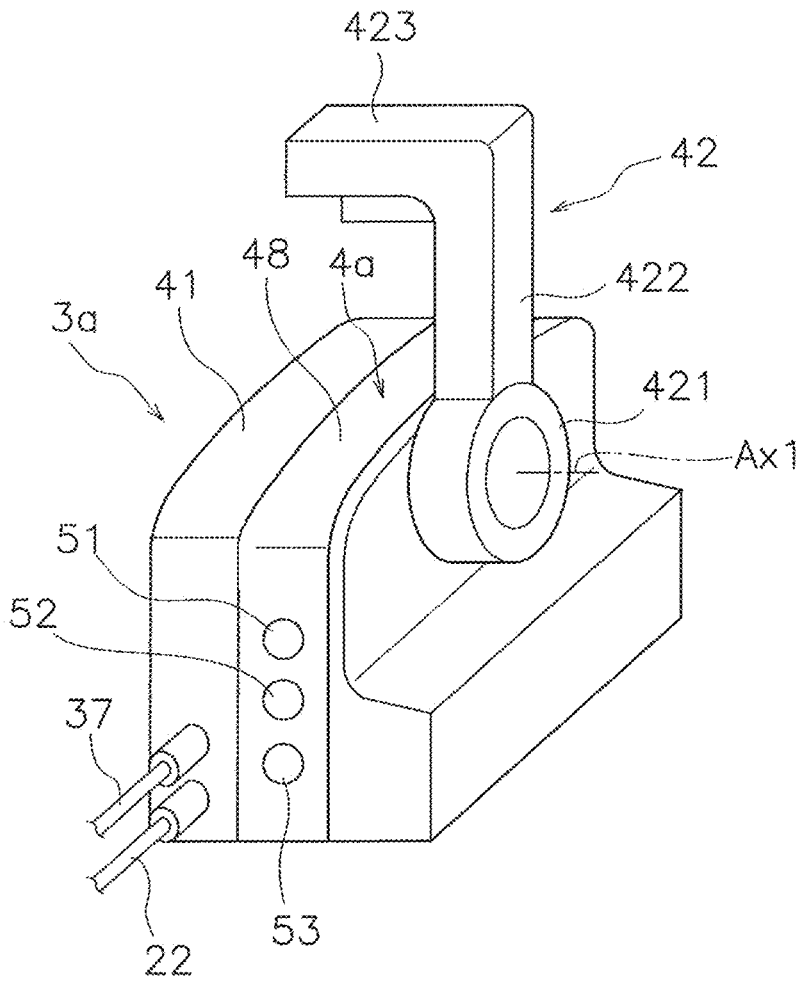
FIG. 3 is a perspective view showing a manual shifter and a boat speed control device according to the first preferred embodiment of the present invention.
Figure 4:
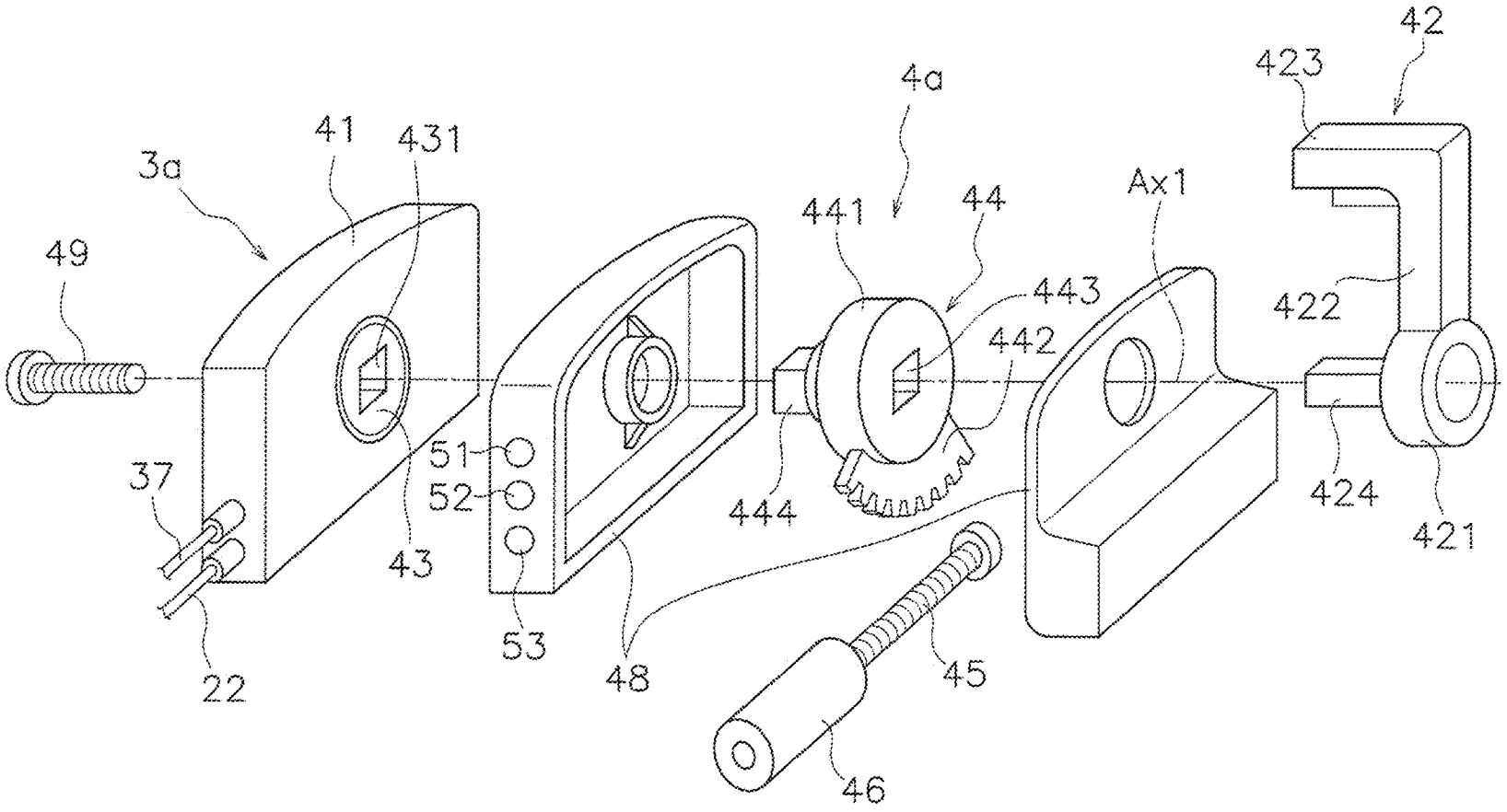
FIG. 4 is an exploded perspective view of the manual shifter and the boat speed control device.
Figure 5:
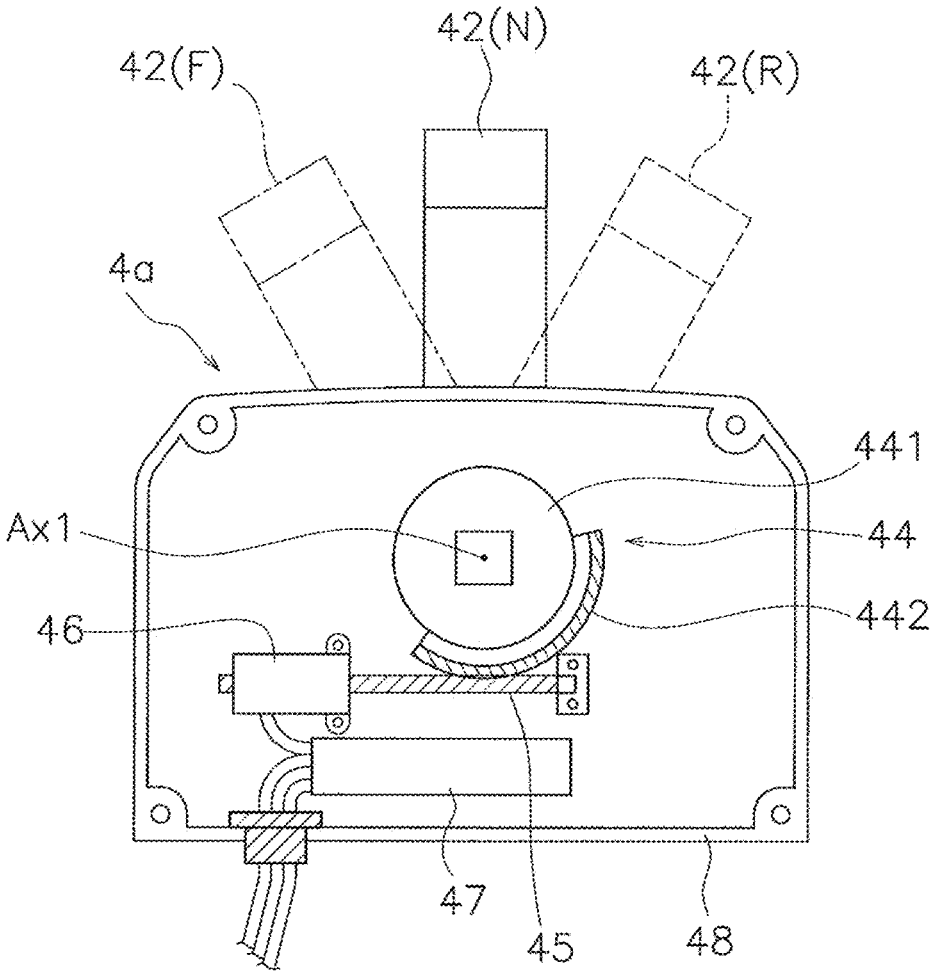
FIG. 5 is a diagram showing an internal structure of the boat speed control device.

FIG. 3 is a perspective view showing the manual shifter 3*a* and the boat speed control device 4*a* according to the first preferred embodiment of the present invention. FIG. 4 is an exploded perspective view of the manual shifter 3*a* and the boat speed control device 4*a*. FIG. 5 is a diagram showing an internal structure of the boat speed control device 4*a*.

The manual shifter 3*a* defines and functions as a remote control connected to the outboard motor 2 via the throttle cable 22 and the shift cable 37. The manual shifter 3*a* includes a main body 41 and a shift lever 42. The shift lever 42 is shiftable in the forward direction, the neutral position, and the reverse direction. The shift lever 42 includes a shaft 421, a lever 422, and a grip 423. The shaft 421 is rotatably supported by the boat speed control device 4*a*. The lever 422 extends in the radial direction from the shaft 421. The grip 423 is connected to the end of the lever 422.

The operator is able to switch the shift position of the shift lever 42 between the forward direction, the neutral position, and the reverse direction by rotating the shift lever 42 about the rotation axis Ax1 of the shaft 421. For example, as illustrated in FIG. 5, the operator rotates the shift lever 42 forward from the neutral position ("42(N)" in FIG. 5), thus changing the shift position from the neutral position to the forward position ("42(F)" in FIG. 5). The operator switches the shift position from the neutral position to the reverse position ("42(R)" in FIG. 5) by rotating the shift lever 42 backward from the neutral position.

As illustrated in FIG. 4, the throttle cable 22 and the shift cable 37 are connected to the main body 41. The shift lever 42 is connected to the throttle cable 22 and the shift cable 37 via the linkage 43 in the main body 41. When the operator operates the shift lever 42, the throttle cable 22 and the shift cable 37 each perform a push-pull operation. Thus, the operator is able to adjust the state of the shift mechanism 15 and the opening degree of the throttle valve 21.

The boat speed control device 4*a* is connected to the manual shifter 3*a*. The boat speed control device 4*a* automatically adjusts the boat speed by automatically operating the manual shifter 3*a*. The boat speed control device 4*a* is disposed between the main body 41 and the shift lever 42. The boat speed control device 4*a* includes a movable member 44, a link 45, an actuator 46, and a housing 48.

The movable member 44 connects the shift lever 42 and the main body 41. The movable member 44 is fixed to the shift lever 42 and the linkage 43 of the main body 41 by a bolt 49, for example. The movable member 44 includes a center portion 441 and a worm wheel 442.

The center portion 441 is fixed to the shaft 421 of the shift lever 42. The worm wheel 442 is connected to the outer peripheral surface of the center portion 441. The link 45 includes a worm gear. The teeth of the link 45 mesh with the teeth of the worm wheel 442. When the link 45 rotates around the axis of the link 45, the movable member 44 rotates around the rotation axis Ax1.

The actuator 46 is connected to the shift lever 42 via the link 45 and the movable member 44. The actuator 46 is, for example, an electric motor. The actuator 46 rotates the link 45 around the axis of the link 45. Thus, the shift lever 42 rotates around the rotation axis Ax1 together with the movable member 44.

The housing 48 is disposed between the main body 41 and the shift lever 42. The housing 48 accommodates the actuator 46, the movable member 44, and the link 45.

As illustrated in FIG. 5, the boat speed control device 4*a* includes a controller 47. The controller 47 includes a processor such as a CPU and a memory such as a RAM and a ROM. The controller 47 stores a program and data that controls the actuator 46. The controller 47 controls the actuator 46 so as to shift the shift lever 42 between the sailing position and the neutral position. In the present preferred embodiment, the sailing position is the forward position. That is, the controller 47 controls the actuator 46 so as to shift the shift lever 42 between the forward position and the neutral position. The controller 47 is accommodated in the housing 48.

The worm wheel 442 is disposed on the movable member 44 in a range between a position corresponding to the neutral position of the shift lever 42 and a position corresponding to the forward position. In other words, the worm wheel 442 is not disposed on the movable member 44 in the range between the position corresponding to the neutral position of the shift lever 42 and the position corresponding to the reverse position of the shift lever 42.

Figure 6:
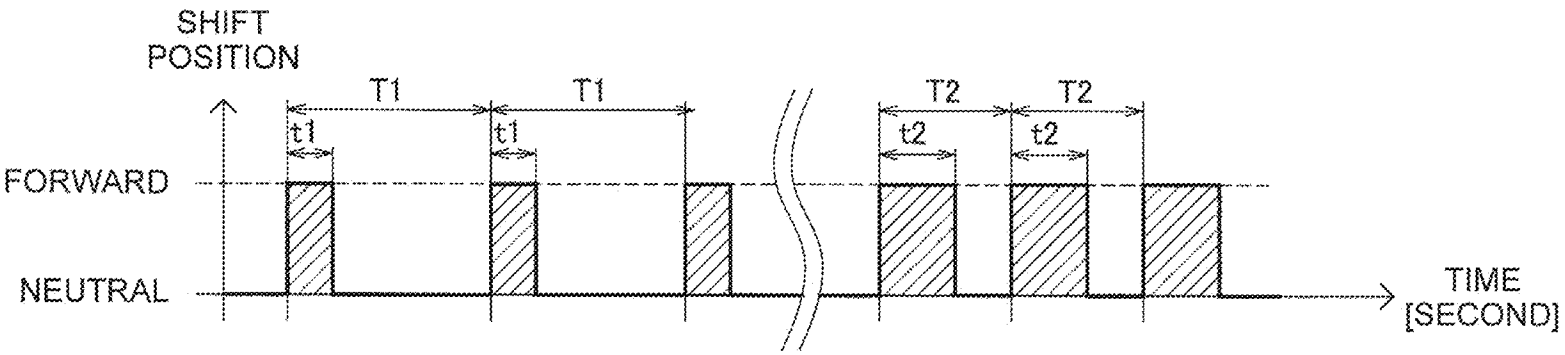
FIG. 6 is a timing chart showing control of the shift lever by the controller.

The controller 47 controls the actuator 46 so that the shift lever 42 is intermittently shifted to the forward position. Thus, the speed of the boat 100 is maintained at an ultra-low speed lower than the speed corresponding to the idling rotation speed of the engine 12. Specifically, as illustrated in FIG. 6, the controller 47 controls the actuator 46 so that the shift-in state and the shift-out state are periodically switched at a predetermined shift operation cycle T1. The shift-in state is a state in which the shift lever 42 is located at the forward position. The shift-out state is a state in which the shift lever 42 is located at the neutral position.

The controller 47 moves the shift lever 42 from the neutral position to the forward position and maintains the shift lever 42 at the forward position for the duration time t1 (shift-in state). Meanwhile, the shift lever 42 is held at a predetermined operation position within the range of the forward position. The predetermined operation position is preferably a position at which the speed of the boat 100 is maintained at the above-described ultra-low speed by intermittent operation of the shift lever 42. After the elapse of the duration time t1, the controller 47 moves the shift lever 42 from the forward position to the neutral position and maintains the neutral position until the current shift operation cycle T1 ends (shift-out state). Thereafter, in the next shift operation cycle T1, the controller 47 moves the shift lever 42 from the neutral position to the forward position. Thus, the controller 47 maintains the speed of the boat 100 at a predetermined target speed by alternately switching between the shift-in state and the shift-out state.

As illustrated in FIG. 3, the boat speed control device 4*a* includes adjustment switches 51 and 52. The adjustment switches 51 and 52 are volume switches, for example. The adjustment switches 51 and 52 may be slide type switches or push button type switches. The adjustment switches 51 and 52 include a first switch 51 and a second switch 52.

The first switch 51 outputs a signal that sets the duration time of the shift-in state. The operator is able to change the duration time of the shift-in state by changing the operation position of the first switch 51. For example, as illustrated in FIG. 6, the operator is able to change the duration time of the shift-in state from t1 to t2 by operating the first switch 51.

The second switch 52 outputs a signal that sets the shift operation cycle. The operator is able to change the shift operation cycle by changing the operation position of the second switch 52. For example, as illustrated in FIG. 6, the operator is able to change the shift operation cycle from T1 to T2 by operating the second switch 52.

When the shift lever 42 is not automatically controlled by the controller 47, the operation of the shift lever 42 by the operator is transmitted to the linkage 43 of the main body 41 through the movable member 44. Therefore, the operator is able to manually operate the opening degree of the shift mechanism 15 and the throttle valve 21 by operating the shift lever 42.

As illustrated in FIG. 3, the boat speed control device 4*a* includes an operation lamp 53. The operation lamp 53 is lit during execution of automatic control by the boat speed control device 4*a*.

According to the boat maneuvering system 1*a* according to the first preferred embodiment described above, the controller 47 controls the actuator 46 to shift the shift lever 42 between the neutral position and the forward position. Therefore, the boat speed control device 4*a* is able to be small and operate the shift lever 42. Therefore, the boat speed control device 4*a* is easily mounted on the small boat 100.

Figure 7:
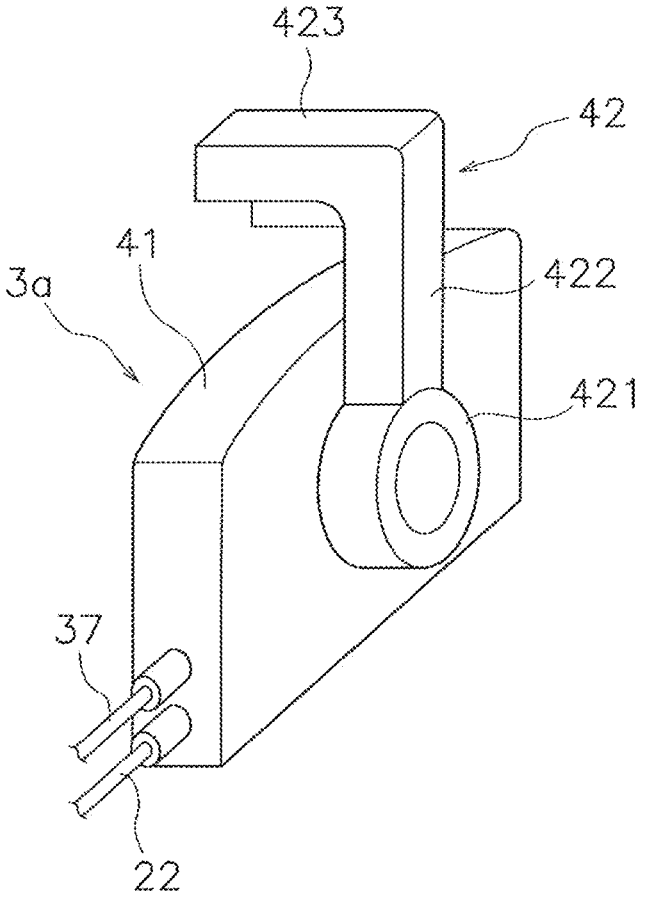
FIG. 7 is a perspective view showing an existing manual shifter before the boat speed control device is attached.

The boat speed control device 4*a* may be attached between the main body 41 and the shift lever 42 of the manual shifter 3*a*. Accordingly, it is easily attached to an existing manual shifter 3*a* as illustrated in FIG. 7. For example, as illustrated in FIG. 4, the movable member 44 includes a first fixing portion 443 and a second fixing portion 444. The first fixing portion 443 has a structure that matches the fixing portion 424 of the shift lever 42. The second fixing portion 444 has a structure that matches the attachment portion 431 of the linkage 43 of the main body 41. Accordingly, in the existing manual shifter 3*a*, by detaching the shift lever 42 from the main body 41, attaching the boat speed control device 4*a* to the main body 41, and attaching the shift lever 42 to the boat speed control device 4*a*, the boat maneuvering system 1*a* is easily mounted on the boat 100.

The boat speed control device 4*a* switches the shift lever 42 only between the forward position and the neutral position. That is, the boat speed control device 4*a* does not switch the shift lever 42 between the reverse position and the neutral position. Therefore, the movable member 44 and the link 45 are reduced in size, and thus the boat speed control device 4*a* is reduced in size.

Figure 8:
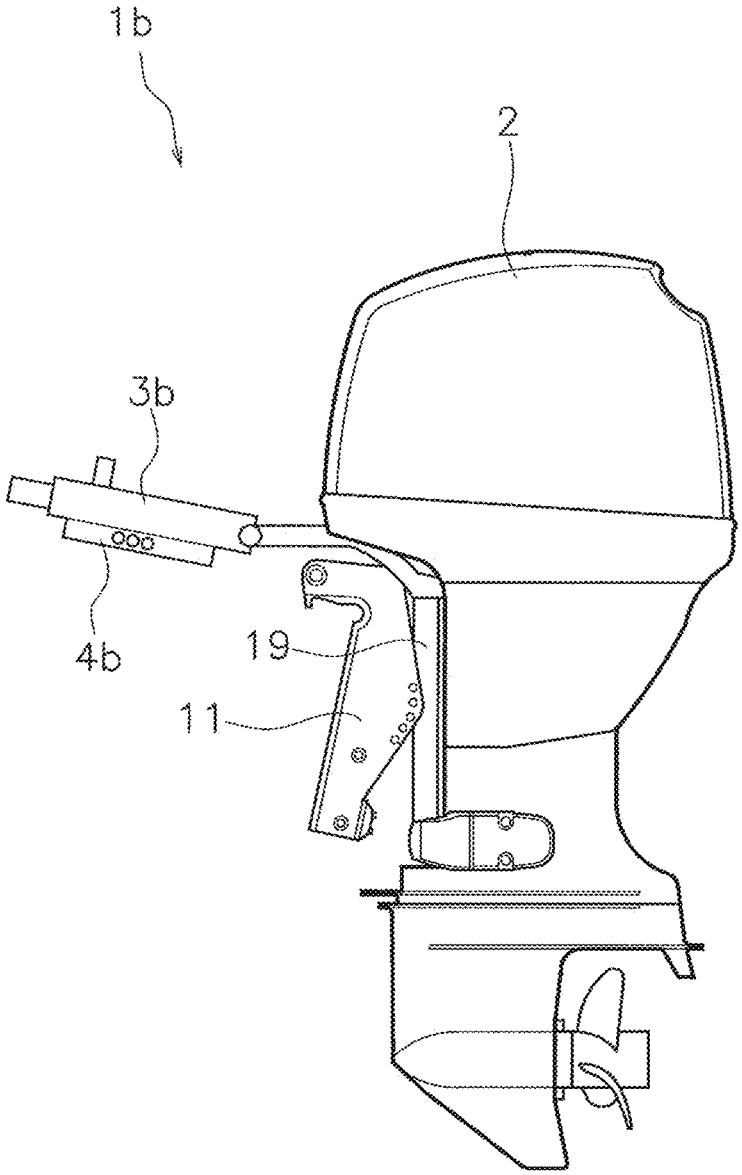
FIG. 8 is a diagram showing a boat maneuvering system according to a second preferred embodiment of the present invention.

Next, a boat maneuvering system 1*b* according to the second preferred embodiment of the present invention will be described. FIG. 8 is a diagram showing the boat maneuvering system 1*b* according to the second preferred embodiment. As illustrated in FIG. 8, the boat maneuvering system 1*b* includes an outboard motor 2, a manual shifter 3*b*, and a boat speed control device 4*b*. Since the outboard motor 2 is the same as that of the first preferred embodiment, detailed description thereof is omitted.

The manual shifter 3*b* includes a tiller handle connected to the outboard motor 2. The manual shifter 3*b* extends forward from the outboard motor 2. The boat speed control device 4*b* is attached to the manual shifter 3*b*.

The outboard motor 2 is supported by the bracket 11 so as to be rotatable around the steering shaft 19. The operator manually rotates the outboard motor 2 around the steering shaft 19 by rotating the manual shifter 3*b* around the steering shaft 19. As the outboard motor 2 rotates around the steering shaft 19, the traveling direction of the boat 1 is changed to the left and right.

Figure 9:
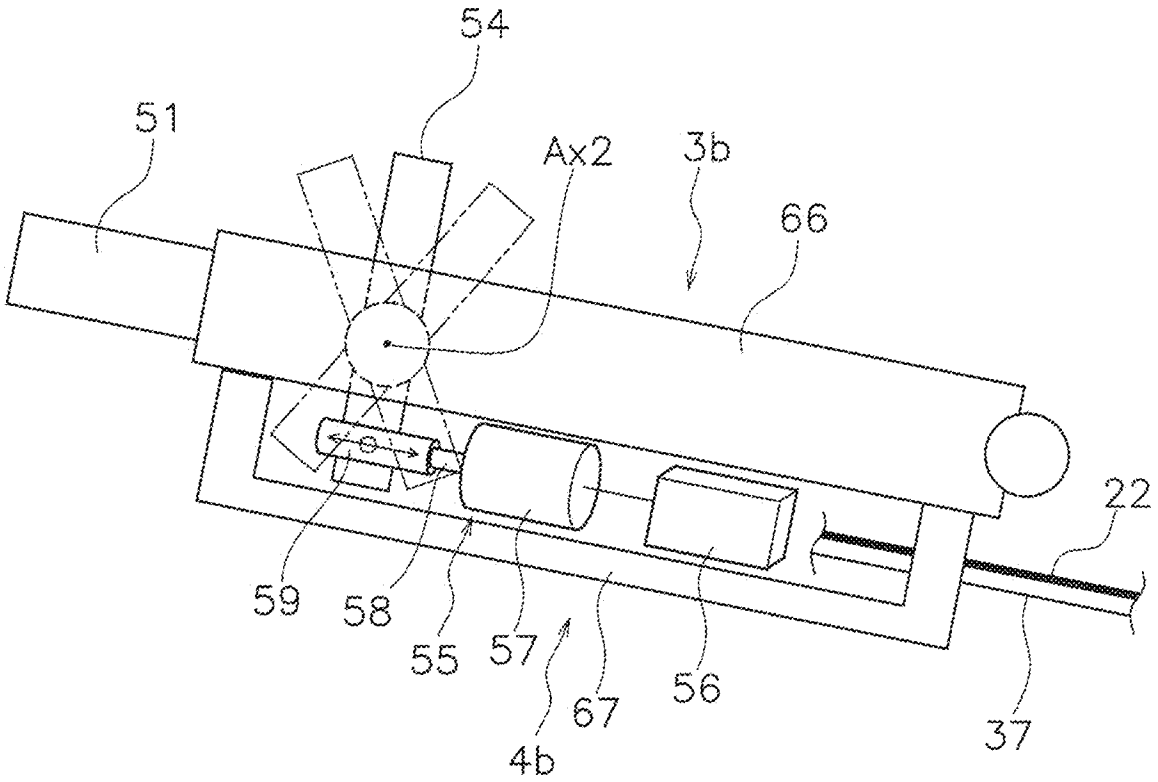
FIG. 9 is a diagram showing an internal structure of a tiller handle.

FIG. 9 is a diagram showing the manual shifter 3*b* and the boat speed control device 4*b* according to the second preferred embodiment. The manual shifter 3*b* includes a grip 51, a first main body 66, a second main body 67, and a shift lever 54. The grip 51 is provided at the end of the manual shifter 3*b* and is a portion that is gripped by the operator. The grip 51 is attached to the first main body 66.

The first main body 66 rotatably supports the shift lever 54. The shift lever 54 is attached to the manual shifter 3*b* so as to be rotatable about the rotation axis Ax2. The shift lever 54 is movable to a forward position, a neutral position, and a reverse position. The rotation axis Ax2 of the shift lever 54 extends in a direction intersecting the longitudinal direction of the manual shifter 3*b*. The shift lever 54 extends in the radial direction from the rotation axis Ax2.

The shift lever 54 is connected to the throttle cable 22 and the shift cable 37. The rotation of the shift lever 54 is transmitted to the throttle valve 21 via the throttle cable 22. The rotation of the shift lever 54 is transmitted to the shift mechanism 15 via the shift cable 37. Similar to the first preferred embodiment, when the operator operates the shift lever 54, the throttle cable 22 and the shift cable 37 each perform a push-pull operation. Thus, the operator is able to adjust the state of the shift mechanism 15 and the opening degree of the throttle valve 21.

The second main body 67 is disposed below the first main body 66. The second main body 67 is detachably attached to the first main body 66. The boat speed control device 4*b* is attached to the second main body 67.

The boat speed control device 4*b* includes an actuator 55 and a controller 56. The actuator 55 is connected to the end of the shift lever 54. The actuator 55 is an electric cylinder, for example. The actuator 55 includes a motor 57, a screw 58, and a rod 59. The motor 57 is, for example, an electric motor. The screw 58 is a slide screw or a ball screw, for example. The rod 59 includes a nut that meshes with the screw 58. The screw 58 is rotated by the motor 57, and the rod 59 is moved in the axial direction of the rod 59 due to the rotation of the screw 58. The rod 59 is connected to the end of the shift lever 54, and the shift lever 54 rotates around the rotation axis Ax2 when the rod 59 moves.

The controller 56 controls the actuator 55 so as to shift the shift lever 54 to the forward position and the neutral position. Since the control of the shift lever 54 by the controller 56 is the same as the control by the controller 47 of the first preferred embodiment, detailed description thereof is omitted. The boat maneuvering system 1*b* according to the second preferred embodiment described above achieves the same effects as the boat maneuvering system 1*a* according to the first preferred embodiment.

Although preferred embodiments of present invention have been described above, the present invention is not limited to the above-described preferred embodiments and various changes can be made without departing from the scope of the present invention.

The boat speed control device 4*a* according to the first preferred embodiment is able to be retrofitted to the existing manual shifter 3*a*. However, the boat speed control device 4*a* may not be retrofitted to the existing manual shifter 3*a*. That is, the boat speed control device 4*a* may be built in the manual shifter 3*a*. The boat speed control device 4*b* according to the second preferred embodiment is preferably the same as the boat speed control device 4*a* according to the first preferred embodiment.

The structure of the shift mechanism 15 is not limited to that of the above-described preferred embodiments, and may be changed. The structure of the manual shifters 3*a* and 3*b* is not limited to that of the above-described preferred embodiments, and may be changed. The structure of the boat speed control devices 4*a* and 4*b* is not limited to that of the above-described preferred embodiments, and may be changed. For example, the structures of the movable member 44 and the link 45 of the boat speed control device 4*a* may be changed. The structure of the screw 58 and the rod 59 of the boat speed control device 4*b* may be changed.

The actuators 46 and 55 are not limited to electric motors, and may be other actuators such as hydraulic actuators.

The configuration of the adjustment switches 51 and 52 may be changed. The adjustment switches 51 and 52 are not limited to mechanical switches, and may be software keys displayed on a touch screen, for example. The controller 47 according to the first preferred embodiment may change the target speed according to the positions of the adjustment switches 51 and 52. Further, the controller 47 may automatically determine the shift operation cycle and the duration time of the shift-in state according to the target speed. Alternatively, the adjustment switches 51 and 52 may be omitted.

The controller 47 may switch the shift lever 54 intermittently between the reverse position and the neutral position. Alternatively, an intermittent operation between the forward position and the neutral position and an intermittent operation between the reverse position and the neutral position may be selectable by the operator. The controller 56 according to the second preferred embodiment may be changed similarly to the controller 47 according to the first preferred embodiment.

In the above-described preferred embodiments, the throttle valve 21 and the shift mechanism 15 are driven by the push-pull operation of the throttle cable 22 and the shift cable 37. However, the throttle valve 21 and the shift mechanism 15 may be driven by an actuator such as an electric motor or a hydraulic motor.

Figure 10:
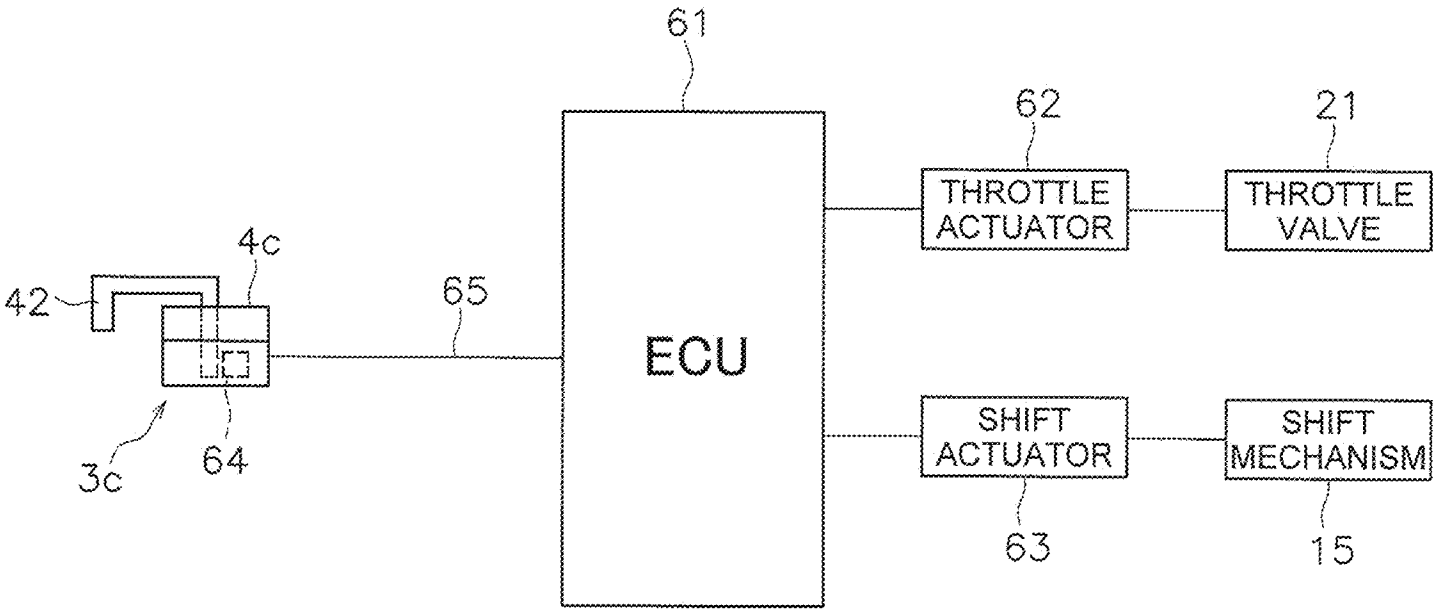
FIG. 10 is a block diagram illustrating a configuration of a boat maneuvering system according to a modified preferred embodiment of the present invention.

FIG. 10 is a block diagram illustrating a configuration of a boat maneuvering system according to a modified preferred embodiment. As illustrated in FIG. 10, the boat maneuvering system according to the modified preferred embodiment may include an ECU 61, a throttle actuator 62, and a shift actuator 63. The ECU 61 includes a processor such as a CPU and a memory such as a RAM and a ROM. The ECU 61 stores a program and data that controls the outboard motor 2. The ECU 61 is communicably connected to the manual shifter 3*c*.

The throttle actuator 62 is an electric motor, for example, and is controlled by a command signal from the ECU 61. The throttle actuator 62 is connected to the throttle valve 21 and changes the opening of the throttle valve 21 in accordance with a command signal from the ECU 61.

The shift actuator 63 is an electric motor, for example, and is controlled by a command signal from the ECU 61. The shift actuator 63 is connected to the shift mechanism 15, for example, the shift rod 35, and controls the shift mechanism 15 according to a command signal from the ECU 61.

The manual shifter 3*c* includes a sensor 64 that detects the position of the shift lever 42. The sensor 64 outputs an operation signal indicating the position of the shift lever 42. An operation signal from the sensor 64 is transmitted to the ECU 61 via the cable 65. That is, in the boat maneuvering system according to the modified preferred embodiment, the cable 65 is a communication line that transmits a signal from the manual shifter 3*c*.

Similar to the boat speed control device 4*a* according to the first preferred embodiment, the boat speed control device 4*c* according to the modified preferred embodiment controls the shift lever 42 of the manual shifter 3*c* so as to shift to the sailing position and the neutral position. In FIG. 10, the manual shifter 3*c* defines and functions as a remote control similar to that of the first preferred embodiment, but may be a tiller handle similar to that of the second preferred embodiment.

The ECU 61 acquires the operation position and the operation amount of the shift lever 42 from the operation signal of the sensor 64. The ECU 61 outputs a command signal to the throttle actuator 62 so as to increase or decrease the engine speed according to the operation amount of the shift lever 42. Further, the ECU 61 switches the shift mechanism 15 to one of the forward movement state, the neutral state, and the reverse movement state in accordance with the operation position of the shift lever 42.

In the various preferred embodiments of the present invention, the controllers control the actuator to shift the shift lever to the neutral position and the sailing position. Therefore, the boat speed control device is able to be small and operate the shift lever. Therefore, the boat speed control device is easily mounted on a small boat.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

The invention claimed is:

1. A boat speed control device for a boat including a manual shifter operably connected to an outboard motor, the manual shifter including a shift lever that shifts between a sailing position and a neutral position, the boat speed control device comprising:

an actuator connected to the shift lever; and a controller configured or programmed to control the actuator to shift the shift lever to the sailing position and the neutral position.

2. The boat speed control device according to claim 1, wherein the shift lever is shiftable to a forward position, a reverse position, and the neutral position;

the sailing position is the forward position; and the actuator is capable of shifting the shift lever only between the neutral position and the forward position.

3. The boat speed control device according to claim 1, wherein the shift lever includes:

a rotatable shaft;

a lever extending in a radial direction from the shaft; and a grip connected to an end of the lever.

4. The boat speed control device according to claim 1, wherein the manual shifter defines a remote control connected to the outboard motor via a cable; and the boat speed control device is connected to the remote control.

5. The boat speed control device according to claim 4, wherein the manual shifter includes a main body to which the cable is connected; and the boat speed control device is disposed between the main body and the shift lever, and transmits motion of the shift lever to the main body.

6. The boat speed control device according to claim 5, further comprising:

a movable member that connects the shift lever and the main body;

a link that connects the movable member and the actuator; and a housing that houses the actuator, the movable member, and the link and is disposed between the main body and the shift lever.

7. The boat speed control device according to claim 1, wherein the manual shifter includes a tiller handle connected to the outboard motor; and the boat speed control device is attached to the tiller handle.

8. The boat speed control device according to claim 7, wherein the shift lever extends in a direction intersecting a longitudinal direction of the tiller handle.

9. The boat speed control device according to claim 8, wherein the tiller handle includes:

a grip;

a first main body to which the grip is attached and that supports the shift lever; and a second main body detachably attached to the first main body; and the boat speed control device is attached to the second main body.

10. The boat speed control device according to claim 1, wherein the controller is configured or programmed to control the actuator to intermittently shift the shift lever to the sailing position.

11. The boat speed control device according to claim 10, wherein the controller is configured or programmed to control the actuator to periodically switch the shift lever at a predetermined shift operation cycle between a shift-in state in which the shift lever is located at the sailing position and a shift-out state in which the shift lever is located at the neutral position.

12. The boat speed control device according to claim 11, further comprising:

an adjustment switch that outputs a signal to set a duration time of the shift-in state and/or the predetermined shift operation cycle.

13. The boat speed control device according to claim 10, wherein the outboard motor includes an engine; and the controller is configured or programmed to control the actuator so that a speed of the boat is lower than a speed corresponding to an idling rotational speed of the engine.

14. A boat maneuvering system comprising:

a manual shifter including a shift lever that shifts between a sailing position and a neutral position;

an outboard motor connected to the manual shifter; and a boat speed control device including:

an actuator connected to the shift lever, and a controller configured or programmed to control the actuator to shift the shift lever to the sailing position and the neutral position.

15. The boat maneuvering system according to claim 14, wherein the shift lever is shiftable to a forward position, a reverse position, and the neutral position;

the sailing position is the forward position; and the actuator is capable of shifting the shift lever only between the neutral position and the forward position.

16. The boat maneuvering system according to claim 14, wherein the manual shifter defines a remote control connected to the outboard motor via a cable; and the boat speed control device is connected to the remote control.

17. The boat maneuvering system according to claim 16, wherein the manual shifter includes a main body to which the cable is connected; and the boat speed control device is disposed between the main body and the shift lever, and transmits motion of the shift lever to the main body.

18. The boat maneuvering system according to claim 17, wherein the boat speed control device includes:

a movable member that connects the shift lever and the main body;

a link that connects the movable member and the actuator; and a housing that houses the actuator, the movable member, and the link, and is disposed between the main body and the shift lever.

19. The boat maneuvering system according to claim 14, wherein the manual shifter includes a tiller handle connected to the outboard motor; and the boat speed control device is attached to the tiller handle.

20. The boat maneuvering system according to claim 19, wherein the tiller handle includes:

a grip;

a first main body to which the grip is attached and that supports the shift lever; and a second main body detachably attached to the first main body; and the boat speed control device is attached to the second main body.

21. The boat maneuvering system according to claim 14, wherein the controller is configured or programmed to control the actuator to intermittently shift the shift lever to the sailing position.

22. The boat maneuvering system according to claim 21, wherein the controller is configured or programmed to control the actuator to periodically switch the shift lever at a predetermined shift operation cycle between a shift-in state in which the shift lever is located at the sailing position and a shift-out state in which the shift lever is located at the neutral position.

23. The boat maneuvering system according to claim 22, further comprising:

an adjustment switch that outputs a signal to set a duration time of the shift-in state and/or the predetermined shift operation cycle.

24. The boat maneuvering system according to claim 21, wherein the outboard motor includes an engine; and the controller is configured or programmed to control the actuator so that a speed of the boat is lower than a speed corresponding to an idling rotational speed of the engine.

* * * * *